United States Patent [19]

Garner

[11] 4,074,888

[45] Feb. 21, 1978

[54] APPARATUS FOR LOCKABLY MOUNTING PICTURE FRAMES AND THE LIKE

[76] Inventor: George H. Garner, 6528 Palomino, Arlington, Tenn. 38002

[21] Appl. No.: 666,180

[22] Filed: Mar. 11, 1976

Related U.S. Application Data

[63] Continuation-in-part of Ser. No. 513,245, Oct. 9, 1974, abandoned.

[51] Int. Cl.[2] ..... A47F 7/14

[52] U.S. Cl. ..... 248/475 R; 248/203; 248/497; 85/1 H

[58] Field of Search ..... 248/466, 489, 475, 497, 248/498, 203; 24/221 R; 40/152, 152.1; 85/9, 1 H, 1 L, 71; 403/11, 19, 27

[56] References Cited

U.S. PATENT DOCUMENTS

| | | | |
|---|---|---|---|
| 1,149,141 | 8/1915 | Hook | 248/489 |
| 1,296,275 | 3/1919 | Firth | 85/1 H X |
| 1,485,990 | 3/1924 | Moore | 24/221 R |
| 2,110,959 | 3/1938 | Lombard | 85/1 LX |
| 2,388,658 | 11/1945 | Pumphrey | 85/1 H X |
| 2,771,259 | 11/1956 | Laystrom | 248/489 |
| 3,143,915 | 8/1964 | Tendler | 248/497 X |
| 3,398,627 | 8/1968 | Tendler | 85/71 |

*Primary Examiner*—Roy D. Frazier
*Assistant Examiner*—Terrell P. Lewis
*Attorney, Agent, or Firm*—John R. Walker, III

[57] ABSTRACT

Subject apparatus includes at least one anchoring socket each being fixedly attached to the wall which is provided with a prepared hole for receiving same. A pin member having an oblong heat portion is included for each anchoring socket and is grippingly received therein whereby outward movement of the pin member is precluded. A platelike element is included for each anchoring socket and is fixedly attached to the back side of the picture frame. Subject apparatus may include a guide member for locating the optimum position of the platelike element on the back side of the picture frame. One embodiment of the pin member includes a plurality of angularly arranged barbs disposed along the length of the shaft portion allowing the pin member to be urged into the socket and to preclude subsequent withdrawal thereof. Another embodiment of the pin member includes male threads and the socket is threaded internally for threaded engagement therewith. One embodiment of the platelike element is provided with an oblong aperture for receiving the head of the pin, i.e., when the major axes thereof are aligned. Another embodiment of the platelike element is provided with a circular-shaped aperture. A pair of restraining wires disposed in a parallel spaced apart relationship are stretched across the aperture to define in part an oblong slot which functions in somewhat the same manner as the oblong aperture except a circular-shaped head portion, i.e., when viewed from the side, may be urged between the restraining wires which are adapted to yieldably spread apart and subsequently capture the head portion. Withdrawal of the head from the platelike element is prevented when the major axes of the oblong head and aperture or slot are misaligned, thereby establishing obscured lock structure thus minimizing unwarranted removal of the picture frame. Subject apparatus may include a tool that can be fitted between the wall and the picture frame for engaging a portion of the pin member to allow the pin member to be manually rotated about its longitudinal axis causing the oblong head of the pin member to be selectively aligned and misaligned with the oblong aperture or slot in the platelike element so that the picture frame can be selectively removed from and/or locked to the wall. The guide member and the tool may be integrally formed as a one-piece unit.

4 Claims, 15 Drawing Figures

APPARATUS FOR LOCKABLY MOUNTING PICTURE FRAMES AND THE LIKE

CROSS-REFERENCE TO RELATED APPLICATION

This is a continuation-in-part of my application, Ser. No. 513,245, filed Oct. 9, 1974, now abandoned, entitled "Apparatus for Lockably Mounting Picture Frames and the Like."

BACKGROUND OF THE INVENTION

1. Field of the Invention

This invention relates to the field of lockable apparatus for mounting picture frames and the like to a wall.

2. Description of the Prior Art

Applicant is aware of the following U.S. patents: the Sacket et al, U.S. Pat. No. 711,348; the Walker U.S. Pat. No. 1,128,560; the Peer U.S. Pat. No. 1,634,884; the Zimmermann U.S. Pat. No. 3,211,409; and the Dennis U.S. Pat. No. 3,612,469. None of the above patents suggest or disclose applicant's apparatus. On certain occasions, many people cannot resist the temptation of removing a frame-mounted picture or painting and the like from places frequented by the general public. Motels and public corridors seem to have considerable problems in this respect. The problem appears to emanate from the fact that attractive desirable pictures and the like may be removed from the wall by simply lifting the picture from the picture mounting hook or the like. Accordingly, many otherwise honest people cannot resist the temptation to place these articles with their personal belongings prior to checking out of the motel.

SUMMARY OF THE INVENTION

The present invention is directed towards providing apparatus which will alleviate the above-described problem. More specifically, the present invention provides apparatus for lockably mounting the picture frame and the like to the wall in such a manner that the locking structure is hidden from view and is substantially inaccessible without special tools whereby unwarranted removal of the painting or the like from the wall is minimized. In other words, it is believed that most of the disappearance of these picture frames would cease if it were more difficult to remove the picture frame from its mounting, and the present invention is directed towards this objective.

The present invention includes at least one anchoring socket, however, several would be more desirable. Each anchoring socket is fixedly attached to the wall which is provided with a prepared hold for receiving the socket. A pin member having an oblong head portion is included for each anchoring socket and is grippingly received therein whereby outward movement along the longitudinal axis of the pin member is precluded. A platelike element is included for each anchoring socket and is fixedly attached to the back side of the picture frame. The present invention may include a guide means for locating the optimum position of the platelike element on the back side of the picture frame. One embodiment of the pin member includes a plurality of barbs disposed along the length of the shaft portion. The barbs are angularly oriented to allow the pin member to be urged into the socket and to preclude subsequent withdrawal thereof. Another embodiment of the pin member includes male threads extending along the length of the shaft. The socket for this latter pin member is threaded internally for suitable engagement therewith.

One embodiment of the platelike element is provided with an oblong aperture for receiving the oblong head portion of the pin member, i.e., when the major axes thereof are aligned. Another embodiment of the platelike element is provided with an enlarged or more circular-shaped aperture and a pair of restraining wires, disposed in a parallel spaced apart relationship, are stretched across the aperture and fixedly attached to the platelike element. The restraining wires define in part an oblong slot which functions in somewhat the same manner as the oblong aperture except a circular-shaped head portion, i.e., circular when viewed from the side, may be urged between the restraining wires which are adapted to yieldably spread apart and subsequently capture the head portion. Withdrawal of the head portion from the platelike element is prevented when the major axes of the oblong head portion and the aperture or slot are misaligned, thereby establishing obscured lock structure thus minimizing unwarranted removal of the picture frame.

The lock structure selectively may be unlocked by aligning the major axes of the oblong head portion and the aperture or slot whereby warranted removal of the picture frame may be effected when desired. The present invention may include a tool means that can be fitted between the wall and the picture frame for engaging a portion of the pin member to allow the pin member to be manually rotated about its longitudinal axis causing the oblong head portion of the pin member to be selectively aligned and misaligned with the oblong aperture or slot in the platelike element so that the picture frame can be selectively removed from and/or locked to the wall. The guide means and the tool means may be integrally formed as a one-piece unit.

DESCRIPTION OF THE DRAWINGS

FIG. 7 is a sectional view of another embodiment of the apparatus shown suitably attached to a solid wall, such as a brick wall or the like.

FIG. 9 shows the pin member exactly as viewed in FIG. 7.

DESCRIPTION OF THE PREFERRED EMBODIMENT

Figure 1:
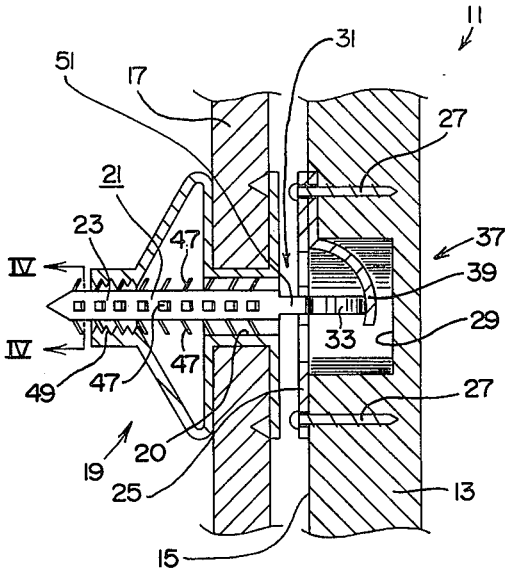
FIG. 1 is a sectional view taken through the vertical center line of the lockable picture mounting apparatus of the present invention, shown attached to a dry wall or the like having a dead-air space beneath the exterior surface thereof.

The apparatus 11 of the present invention is intended for mounting a portable object 13, e.g., a picture frame or the like having a back side 15 to a fixed surface 17, e.g., gypsum board dry wall or the like which typically has a dead-air space between the walls. The apparatus 11 as herein disclosed includes at least one anchoring socket means 19. However, it will be understood that the present invention anticipates the use of more than one anchoring socket means 19 for attaching a picture frame 13 to a fixed surface or wall 17. Each of the anchoring socket means 19 is fixedly attached to the wall 17 in a manner well known to those skilled in the art, i.e., a prepared hole as at 20, is suitably provided in the wall 17. In this regard, it should be pointed out that an anchoring socket means of the type herein disclosed is shown in U.S. Pat. No. 2,559,281, issued July 3, 1951 to G. F. Croessant. While a brief description of the anchoring socket means 19 will suffice for present purposes, reference should be made to the Croessant patent for a more detailed description of the character and structure of the anchoring socket means.

The apparatus 11 also includes a pin member 21 for each anchoring socket 19. Each pin member 21 is received in the socket means 19 with a portion thereof, as at 23, grippingly engaging the socket means 19 whereby outward movement along the longitudinal axis of the pin member 21 is precluded, in a manner to be more fully disclosed later in the specification.

The apparatus 11 also includes a platelike element 25 for each anchoring socket means 19. Each platelike element 25 is fixedly attached to the back side 15 of the picture frame 13 in any well-known manner, as with a plurality of screws 27 or the like. In this regard, it should be pointed out that preparatory to attaching the platelike element 25 to the picture frame 13 a socket well or bore, as at 29, is suitably provided therein. Additionally, the apparatus 11 may include a guide means 101 for locating the optimum position of the platelike element 25 on the back side 15 of the picture frame 13. More specifically, the guide means 101 preferably consists of a thin, rigid body portion 103 having a top edge 105 for being aligned with the top or bottom edge of the picture frame 13 and having a side edge 107 for being aligned with one of the side edges of the picture frame 13 (see FIG. 14). The body portion 103 of the guide means 101 also has an aperture 109 therethrough for allowing a mark to be made therethrough with a pencil or the like (not shown) on the back side 15 of the picture frame 13. The aperture 109 is spaced away from the top edge 105 of the body portion 103 of the guide means 101 a distance that corresponds to the optimum distance that it is desired to locate the center of the platelike element 25 from the top or bottom edge of the picture frame 13. Likewise, the aperture 109 is spaced away from the side edge 107 of the body portion 103 of the guide means 101 a distance that corresponds to the optimum distance it is desired to locate the center of the platelike element 25 from the side edges of the picture frame 13. It should be noted that the optimum distances that it is desired to locate the center of the platelike element 25 from the top or bottom edge and from the side edges of the picture frame 13 may vary because of the size of the picture frame 13 and the like. Thus, the distance the aperture 109 is spaced away from the top edge 105 and the side edge 107 of the body portion 103 of the guide means 101 may likewise vary.

The apparatus 11 also includes lock means, as at 31, for removably locking the platelike element 25 to the pin member 21 with the lock means 31 being hidden from view and being substantially inaccessible to obscure the structure thereof whereby unwarranted removal of the picture frame 13 from the wall 17 is minimized.

Figure 2:
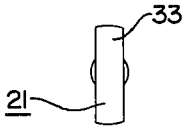
FIG. 2 is an end view of one embodiment of the pin member.
Figure 3:
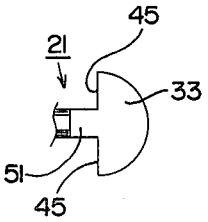
FIG. 3 is a partial view looking down on the pin member shown in FIGS. 1 and 2.
Figure 4:
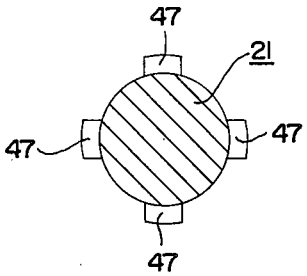
FIG. 4 is a sectional view taken as on the line IV—IV of FIG. 1.
Figure 5:
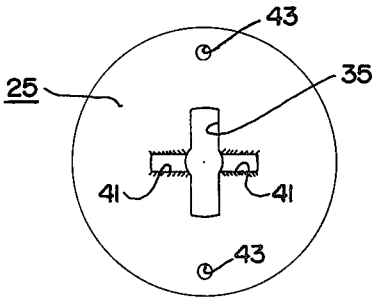
FIG. 5 is a view of the back side of one embodiment of the platelike element herein disclosed, showing an oblong aperture and depressions therein.

The lock means 31 includes providing the pin member 21 with an oblong head portion 33 which is fixedly attached to the outer end thereof as clearly shown in FIGS. 2 and 3 of the drawing. Additionally, the platelike element 25 (FIG. 5) is provided with an oblong aperture 35 having a size compatible with the oblong head portion 33 to allow free passage therethrough when the major axes of the oblong head portion 33 and the aperture 35 are aligned. The lock means 31 is locked so withdrawal of the head portion 33 from the platelike element 25 is prevented when the major axes of the oblong head portion 33 and the aperture 35 are misaligned. A preferred technique for aligning and misaligning the major axes of the oblong head portion 33 and the oblong aperture 35 will be discussed later in the specification.

The apparatus 11 may include detent means, as at 37, for checking the oblong head portion 33 in a predetermined position with respect to the oblong aperture 35. The detent means 37 preferably includes a cliplike spring member 39 fixedly attached to the platelike element 25 as best shown in FIG. 1 of the drawing. Additionally, a pair of remotely disposed valleys or depressions 41 are provided in the platelike element 25 as clearly shown in FIG. 5 of the drawing. It should be understood that the platelike element 25 preferably is provided with a plurality of apertures 43 which receive the screws 27. In this regard, the spring member 39 may be fixedly attached to the platelike element 25 in any conventional manner and the spring member 39 may be provided with an aperture for also receiving one of the screws 27 as clearly shown in FIG. 1 of the drawing. The spring member 39 engages the head portion 33 of the pin member 21 and yieldably urges the pin member 21 toward the platelike element 25. Accordingly, the straight portions, as at 45, of the head 33 are yieldably urged into the depressions 41, i.e., when the major axis of the oblong head 33 is perpendicularly disposed with respect to the major axis of the oblong aperture 35.

The pin member 21 preferably includes a plurality of radially disposed barb portions, as at 47, protruding outwardly at random locations along its length for engaging the anchoring socket means 19. From FIG. 1 of the drawing it may clearly be seen that the barb portions 47 are angularly oriented to allow the pin member 21 to be urged into the socket means 19 and to preclude subsequent withdrawal thereof. In other words, the anchoring socket means 19 has a portion thereof threaded internally, as at 49, and the barb portions 47 bite into the internal threads 49 as clearly shown in FIG. 1 of the drawing. In this manner, the pin member 21 need not be threaded into the socket 19 but rather can simply be urged therein, facilitating more rapid installation of the apparatus 11.

Figure 12:
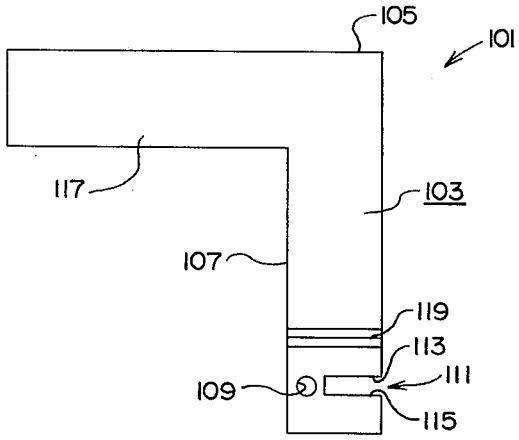
FIG. 12 is an elevational view of the guide means and tool means of the present invention shown integrally formed as a one-piece unit.

The pin member 21 preferably includes a tool engagable portion, as at 51, disposed adjacent the head portion 33. The tool engaging portion 51 facilitates locking and unlocking the lock means 31 in a manner about to be described. The tool engageable portion 51 may be engaged with a knifelike tool means of the apparatus 11. The tool means is simply fitted between the wall 17 and the picture frame 13 and engages the tool engageable portion 51 for manual rotation about the longitudinal axis of the pin member 21. The knifelike tool may be integrally formed with the guide means 101 as a one-piece unit. That is, the body portion 103 of the guide means 101 may be provided with a slot 111 in one edge thereof (see FIG. 12) which defines a pair of spaced apart jaws 113, 115, corresponding to the flats illustrated for the tool engageable portion 51. Thus, to lock or unlock the lock means 31, the body portion 103 is fitted between the wall 17 and the picture frame 13 so that the slot 111 engages the tool engageable portion 51 of the pin member 21 and is then manually turned so that the pin member 21 rotates about its longitudinal axis to align or misalign the oblong head portion 33 of the pin member 21 with the aperture 35 of the platelike element 25. The slot 111 is preferably located the same distance away from the top edge 105 of the body portion 103 as the aperture 109 for reasons which will hereinafter become apparent. The body portion 103 may be provided with a handle 117 to aid in the manual turning thereof.

Figure 14:
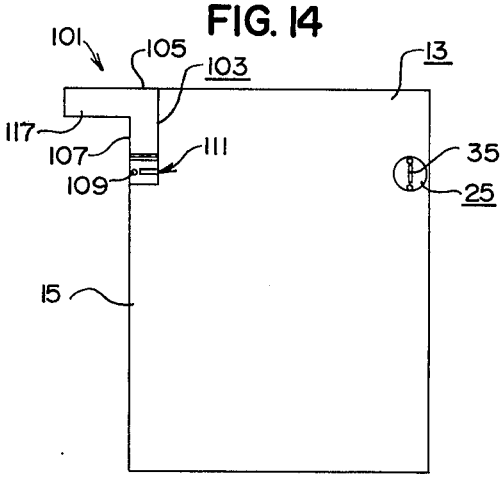
FIG. 14 is an elevational view of the guide means of the present invention shown positioned on a picture frame.

To lockably mount a picture frame 13 to the wall 17, the first step is to locate the optimum position of the platelike element 25 on the back side 15 of the picture frame 13. This is done by positioning the body portion 103 of the guide means 101 on the back side 15 of the picture frame 13 with the top edge 105 thereof aligned with the top or bottom edge of the picture frame 13 and with the side edge 107 thereof aligned with one of the side edges of the picture frame 13 as shown in FIG. 14 of the drawing. A mark is then made on the back side 15 of the picture frame 13 through the aperture 109. It should be noted that when the guide means 101 and the knifelike tool are integrally formed as a one-piece unit, the mark may be made through the slot 111 rather than the aperture 109 so that the aperture 109 may be omitted. Next, the socket well or bore 29 is formed in the back side 15 of the picture frame 13 at the location thereon where the mark was made. The platelike element 25 is then attached to the back side 15 of the picture frame 13 with the oblong aperture 35 positioned over the bore 29. The picture frame 13 is then positioned on the wall 17 so that the oblong head portion 33 of the pin member 21 extends into the oblong aperture 35 of the plate element 25. The knifelike tool is positioned between the wall 17 and the picture frame 13 so as to engage the tool engagable portion 51 of the pin member 21. The knifelike tool is then manually turned approximately 90° so as to misalign the oblong head portion 33 of the pin member 21 with the oblong aperture 35 of the plate element 25 thereby causing the picture frame 13 to be locked to the wall 17 whereby unwarranted removal thereof is minimized without the use of special tools.

Figure 13:
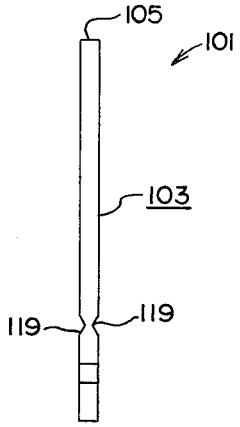
FIG. 13 is a side view of FIG. 12.
Figure 15:
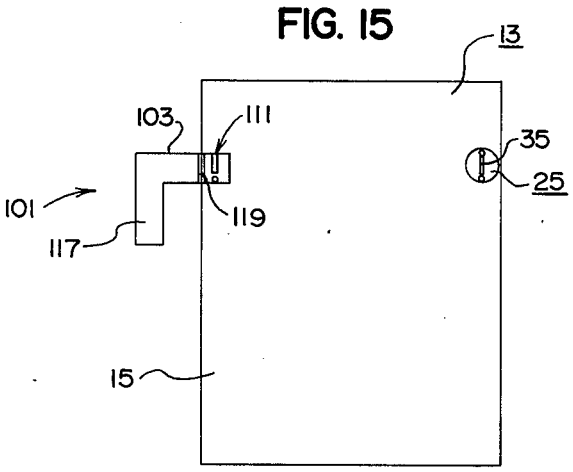
FIG. 15 is an elevational view of the tool means of the present invention shown positioned on a picture frame.

To remove the picture frame 13 from the wall 17 once it has been so mounted thereto, the knifelike tool is inserted between the wall 17 and the picture frame 13 so as to engage the tool engagable portion 51 of the pin member 21. It should be noted that where the knifelike tool is integrally formed with the guide means 101 as a one piece unit, the slot 111 can be easily and quickly aligned with the tool engagable portion 51 by aligning the top edge 105 of the body portion 103 with the top or bottom edge of the picture frame 13 and moving the body portion 103 towards the opposite side of the picture frame 13. This is so since the center of the plate element 25 is located on the picture frame 13 a distance from the top or bottom edge thereof that is equal to the distance between the slot 111 and the top edge 105 of the body portion 103. The body portion 103 is then manually turned approximately 90° so as to align the oblong head portion 33 of the pin member 21 with the oblong aperture 35 of the plate element 25 thereby allowing the picture frame 13 to be removed from the wall 17. It should be noted that indicia 119 may be provided on the body portion 103 so as to indicate when it has been so turned approximately 90°. That is, when the indicia 119 is aligned with the side of the picture frame 13 (see FIG. 15), the oblong head portion 33 of the pin member 21 will be aligned with the oblong aperture 35 of the plate element 25. The indicia 119 may be in the form of grooves or the like cut into each side of the body portion 103 (see FIG. 13). The lock means 31 is thus selectively unlocked by turning the pin member 21 so as to align the major axes of the oblong head portion 33 and the aperture 35 providing for warranted removal of the picture frame 13 from the wall 17 when desirable.

Figure 7:
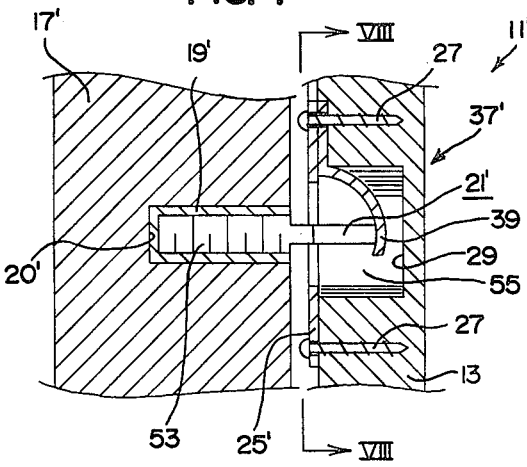

Another embodiment of the apparatus herein disclosed is clearly depicted in FIG. 7 of the drawing and is character referenced therein by the numeral 11'. It should be understood that structure associated with the apparatus 11' which is substantially identical to the previously described structure will be characterized by like references. On the other hand, structure of the apparatus 11' hereinafter disclosed which is somewhat different in character will be identified by like reference having a prime suffix. Further, previously undisclosed structure will be characterized by peculiar numerical references.

The apparatus 11' is primarily intended for accomplishing the same objectives as above described for the principal embodiment, however, the apparatus 11' is particularly directed towards mounting the picture frame 13 to a solid fixed surface or wall 17', e.g., a brick or concrete wall. Therefore, the anchoring socket means 19' is preferably of a well-known lead or plastic shield insert which is fixedly anchored into the socket wall or bore 29' in a manner well known to those skilled in the art. The anchoring socket means 19' is threaded internally for threaded engagement with a bolt or the like. Accordingly, the pin member 21' includes an externally threaded shaft, as at 53, for threadedly engaging the internally threaded socket 19'.

The pin member 21' also includes a fixedly attached head portion 33' having an arcuate terminus, as at 55, establishing the outer end of the pin member 21'.

Figure 6:
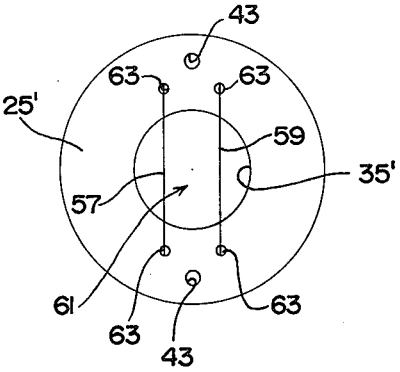
FIG. 6 is a view similar to FIG. 5 which depicts another embodiment of the platelike element herein disclosed.
Figure 8:
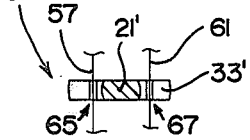
FIG. 8 is a sectional view taken as on the line VIII—VIII of FIG. 7 showing one manner in which the frame is locked to the wall by the pin member.

From FIG. 6 of the drawing it may clearly be seen that the platelike element 25' is provided with an aperture 35' which is compatibly sized with the head portion 33' to allow for free passage therethrough of the head portion 33'. Also included therewith are a pair of restraining wires, as at 57, 59, disposed in a parallel spaced apart relationship and extending across the aperture 35' to define in part an oblong slot, as at 61. The remote ends of the restraining wires 57, 59 are fixedly attached to the platelike element 25', in any well known manner as with wire connectors 63 or the like. The intermediate portions of the restraining wires 57, 59 are free to yieldably spread apart as the arcuate head portion 33' of the pin member 21' is urged therebetween, thus passing through the oblong slot 61 with the restraining wires 57, 59 subsequently capturing the head portion 33' as indicated in FIG. 8 of the drawing. Accordingly, the head portion 33' and the pair of restraining wires 57, 59 constitute the lock means 31'.

From FIG. 8 of the drawing it may also be seen that the head portion 33' of the pin member 21' is oblong when viewed from the end. In other words, the oblong head portion 33' may freely pass through the oblong slot 61 when the major axes thereof are suitably aligned, i.e., without spreading the restraining wires 57, 59.

The apparatus 11' also includes detent means 37' for checking the oblong head portion 33' in a predetermined position with respect to the oblong slot 61. The detent means 37' includes the cliplike spring member 39 and providing a pair of recesses, as at 65, 67 clearly shown in FIGS. 8 and 10 of the drawing for receiving the respective restraining wires 57, 59, i.e., when the major axis of the oblong head 33' is perpendicularly disposed with respect to the major axis of the oblong slot 61.

Figure 10:
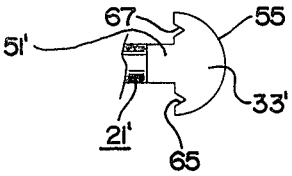
FIG. 10 is a partial view looking down on the pin member shown in FIGS. 7–9.
Figure 9:
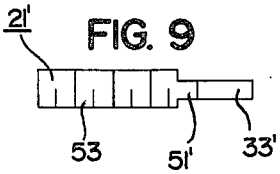
FIG. 9 is a side elevational view of another embodiment of the pin member.

The pin member 21' also includes a tool engageable portion 51' as clearly shown in FIGS. 9 and 10 of the drawing. The tool engageable portion 51' facilitates engaging the pin member 21' for manual rotation about the longitudinal axis thereof to enable the lock means 31' to selectively be unlocked by aligning the major axes of the oblong head portion 33' and the oblong slot 61 whereby warranted removal of the picture frame 13 from the solid wall 17' may be effected, i.e., using the knifelike tool means previously described.

Figure 11:
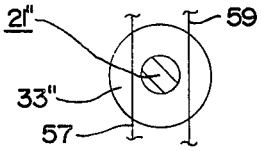
FIG. 11 is a sectional view of still another embodiment of the pin member with the view being taken on the same line as indicated for FIG. 8.

FIG. 11 of the drawing depicts still another embodiment of the pin member and is character referenced therein by the numeral 21''. The pin member 21'' includes the externally threaded shaft (not shown), i.e., like the pin member 21', for threaded engagement with the internally threaded socket 19'. The pin member 21'' includes a circular head portion 33'' when viewed from the end. Additionally, the head portion 33' has an arcuate terminus (not shown), i.e., like the arcuate terminus 55 previously described for the head portion 33'. Further, the size of the head portion 33' is such that it is free to pass through the aperture 35' in the platelike element 25'. Accordingly, the intermediate portions of the restraining wires 57, 59 yieldably spread apart as the arcuate head portion 33'' of the pin member 21'' is urged therebetween thus passing through the oblong slot 61 with the restraining wires 57, 59 subsequently capturing the head portion 33'', as indicated in FIG. 11 of the drawing. In other words, the picture frame 13 is permanently locked to the solid wall 17' by using the pin member 21''. Accordingly, removal of the picture frame 13 from the solid wall 17' can best be accomplished by severing the shaft of the pin member 21'' in any conventional manner, e.g., as with the use of a hacksaw or the like, in which case the pin member 21'' is simply discarded and replaced with a new pin member 21'', i.e., for subsequent remounting of the picture frame 13.

Although the invention has been described and illustrated with respect to preferred embodiments thereof, it is to be understood that it is not to be so limited since changes and modifications may be made therein which are within the full intended scope of the invention.

I claim:

1. Apparatus for mounting a portable object having a back side to a fixed surface, said apparatus comprising at least one anchoring socket means fixedly attached to said fixed surface, a pin member received in each of said socket means with a portion thereof grippingly engaging said socket means whereby outward movement of said pin member is precluded, at least one platelike element fixedly attached to the back side of the portable object, guide means for locating the optimum position of said platelike element on the back side of the portable object, said guide means including a thin, rigid body portion having a top edge for being aligned with the top or bottom edge of the portable object and having a side edge for being aligned with one of the side edges of the portable object and having an aperture therethrough for allowing a mark to be made therethrough with a pencil or the like on the back side of the portable object when said body portion is positioned on the back side of the portable object with said top edge aligned with the top or bottom edge of the portable object and with said side edge aligned with one of the side optimum of the portable object, said mark corresponding to the optmum position of the center of said platelike element, and lock means for removably locking said platelike element to said pin member with said lock means being hidden from view and being substantially inaccessible without special tools to obscure the structure thereof whereby unwarranted removal of the object from the fixed surface is minimized.

2. Apparatus for mounting a portable object having a back side to a fixed surface, said apparatus comprising at least one anchoring socket means fixedly attached to said fixed surface, a pin member received in each of said socket means with a portion thereof grippingly engaging said socket means whereby outward movement of said pin member is precluded, at least one platelike element fixedly attached to the back side of the portable object, guide means for locating the optimum position of said platelike element on the back side of the portable object, lock means for removably locking said platelike element to said pin member with said lock means being hidden from view and being substantially inaccessible to obscure the structure thereof whereby unwarranted removal of the portable object from the fixed surface is minimized, and tool means for engaging said pin member and for manually rotating said pin member about the longitudinal axis thereof to selectively lock and unlock said lock means, said guide means and said tool means being integrally formed as a one-piece unit.

3. Apparatus for mounting a portable object having a back side to a fixed surface, said apparatus comprising at least one anchoring socket means fixedly attached to said fixed surface, said fixed surface being provided with a hole for receivinbg said anchoring socket means; a pin member received in said socket means and including a plurality of radially disposed barb portions protruding outwardly at random locations along the length thereof for grippingly engaging said anchoring socket means, said barb portions being angularly oriented to allow said pin member to be urged into said socket means and to preclude subsequent withdrawal thereof; a platelike element fixedly attached to the back side of the portable object, said pin member including an oblong head portion fixedly attached to the outer end thereof, and said platelike element being provided with an oblong aperture having a size compatible with said oblong head portion to allow free passage therethrough when the major axes of said oblong head portion and said aperture are aligned, withdrawal of said head portion of said pin member from said platelike element being prevented when the major axes of said oblong head portion and said aperture are misaligned, said pin member and said platelike element being hidden from view and being substantially inaccessible without special tools to obscure the structure of said lock means whereby unwarranted removal of the portable object from the fixed surface is minimized; guide means for locating the optimum position of said platelike element on the back side of the portable object; and tool means for engaging said pin member and for manually rotating said pin member about the longitudnal axis thereof to selectively lock and unlock said platelike element to said pin member, said guide means and said tool means being integrally formed as a one-piece unit.

4. Apparatus for mounting a portable object having a back side to a fixed surface, said apparatus comprising at least one anchoring socket means fixedly attached to said fixed surface, a pin member received in each of said socket means with a portion thereof grippingly engaging said socket means whereby outward movement of said pin member is precluded, at least one platelike element fixedly attached to the back side of the portable object, guide means for locating the optimum position of said platelike element on the back side of the portable object, lock means for removably locking said platelike element to said pin member with said lock means being hidden from view and being substantially inaccessible to obscure the structure thereof whereby unwarranted removal of the portable object from the fixed surface is minimized, and tool means for selectively locking and unlocking said lock means, said guide means and said tool means being integrally formed as a one-piece unit.

* * * * *